US007367145B2

(12) United States Patent
Mou

(10) Patent No.: US 7,367,145 B2
(45) Date of Patent: May 6, 2008

(54) NOVELTY ITEM

(76) Inventor: Oliver C. Mou, 11417 Orazio Dr., Las Vegas, NV (US) 89138

( * ) Notice: Subject to any disclaimer, the term of this patent is extended or adjusted under 35 U.S.C. 154(b) by 207 days.

(21) Appl. No.: 11/255,574

(22) Filed: Oct. 21, 2005

(65) Prior Publication Data

US 2007/0113435 A1 May 24, 2007

(51) Int. Cl.
*G09F 3/00* (2006.01)

(52) U.S. Cl. ..... 40/324; 40/310; 40/650; 40/660; 40/649; 215/379; 215/900; 362/101; 362/154; 362/234; 362/235; 362/800; 362/84

(58) Field of Classification Search ..... 40/310, 40/324, 624.02, 649, 650, 654.1, 660, 661, 40/661.05, 605; 215/379, 900; 220/4.04, 220/4.08, 4.11, 4.26, 662, 681; 362/101, 362/154, 234, 235, 84, 800; 206/371
See application file for complete search history.

(56) References Cited

U.S. PATENT DOCUMENTS

| | | | | |
|---|---|---|---|---|
| 2,663,866 | A * | 12/1953 | Simpson | 340/689 |
| 2,696,323 | A * | 12/1954 | Sanderson | 220/4.04 |
| 4,377,231 | A * | 3/1983 | Murphy | 220/4.26 |
| 4,928,412 | A * | 5/1990 | Nishiyama | 40/324 |
| 5,092,488 | A * | 3/1992 | Pradel | 220/600 |
| 6,076,940 | A * | 6/2000 | Sanford, Jr. | 362/253 |
| D455,853 | S | 4/2002 | Henry et al. | |
| 6,676,269 | B1 * | 1/2004 | Dorney | 362/34 |
| 6,762,734 | B2 * | 7/2004 | Blotky et al. | 345/45 |
| 6,855,052 | B2 | 2/2005 | Weiss et al. | |
| 7,075,226 | B2 * | 7/2006 | Cok | 313/504 |
| 7,128,230 | B2 * | 10/2006 | Jacobson et al. | 220/4.26 |
| 7,284,873 | B2 * | 10/2007 | Poulsen | 362/96 |
| 2007/0108149 | A1 * | 5/2007 | Lee et al. | 211/189 |

* cited by examiner

*Primary Examiner*—Lesley D. Morris
*Assistant Examiner*—Shin Kim
(74) *Attorney, Agent, or Firm*—Weide & Miller, Ltd.

(57) ABSTRACT

A novelty item has a base and a display extending upwardly from the base. The display comprises at least a first segment and at least a second segment each having an outer cylindrical wall and an inner cylindrical wall, the inner and outer walls separated from one another thereby defining a first interior space, and the inner cylindrical wall defining a second interior space. A divider is located between the first and second segments, the divider supporting the second segment over the first segment in generally vertical alignment, the display having a generally open top leading to an interior of the display defined by the second interior space of said first and second segment. The novelty item may have the appearance of a gaming machine "top" light and may be also be configured for utilitarian use, such as a writing utensil holder or mug.

18 Claims, 3 Drawing Sheets

NOVELTY ITEM

FIELD OF THE INVENTION

The present invention relates to novelty items, and particularly to a gaming-related novelty item.

BACKGROUND OF THE INVENTION

Novelty items are extremely popular. Novelty items are frequently sold as souvenirs to tourists, both for themselves and for distribution as gifts. Wide varieties of novelty items are known, and they frequently are "themed" to have particular applicability to the destination of the tourist.

Gaming is now a very popular activity, and Las Vegas is a particularly desirable gaming destination. Visitors to Las Vegas commonly seek souvenirs of their trip. Miniature slot machines and shirts, hats and other items bearing images or text regarding Las Vegas or gaming activities are very popular.

A need exists for other unique and exciting novelty goods, especially those which are associated with gaming activities and which may have some beneficial use.

SUMMARY OF THE INVENTION

The present invention is a novelty item. In one embodiment, the novelty item bears resemblance to a feature or element of the gaming environment. In a preferred embodiment, the novelty item resembles a gaming machine "top", "candle" or "tower light." In addition, the novelty item of the invention is preferably configured for utilitarian function, such as by being configured for use as a container.

In one embodiment of the invention, the novelty item has a base and a display extending upwardly from the base. The display comprises at least a first segment and at least a second segment. A divider is located between the first and second segments, the divider supporting the second segment over the first segment in generally vertical alignment. Preferably, the display has a generally open top leading to an interior of the display.

In one embodiment, the segments of the display have varying appearances. In one embodiment, the segments appear in one or more different colors.

In one embodiment, each segment has an outer cylindrical wall and an inner cylindrical wall, the inner and outer walls separated from one another thereby defining a first interior space, and the inner cylindrical wall defining a second interior space. The outer wall of each segment may be generally transparent, while the inner wall may be colored (such as white, red, blue or the like).

The segments may bear text, images, or other information. For example, the segments may bear text regarding the source of the novelty item, such as "Las Vegas, Nevada." In the embodiment where the segments are constructed of two separate walls, inserts bearing text, images or the like may be positioned in the interior space between the walls of the segments.

The "tower light" novelty item may have a variety of configurations. For example, the novelty item may be constructed of more than two segments, such as three or more segments. Preferably, pairs of the segments of the novelty item are separated by a divider. In one embodiment, a cap may be located at the top of the novelty item. The cap may comprise, for example, a ring located at the top of the top-most segment.

In one embodiment, the novelty item may be illuminated or otherwise include one or more lights. In a preferred embodiment, one or more lights are associated with a support. The support may be ring-shaped. Preferably, the lights are configured to illuminate one or more of the segments of the novelty item. For example, a light ring may be located beneath each segment.

In one embodiment, the base may also include one or more lights. In one embodiment, a logo may be associated with the base. One or more lights may be associated with that logo, either to enhance the appearance thereof, to illuminate the logo, or both.

While the novelty item preferably resembles gaming paraphernalia, in one embodiment, the novelty item is configured as a container. The display and/or base may define an interior space usable as a container. In one embodiment, the novelty item may be configured as a writing implement holder. In such embodiment, the novelty item is preferably generally tall in relation to its width, whereby writing implements placed therein are stored in a generally upright position. In another embodiment, the novelty item may be configured for use as a liquid container. In such embodiment, the novelty item is preferably liquid-tight. The novelty item may be relatively short and wide, such as for use as a mug.

Further objects, features, and advantages of the present invention over the prior art will become apparent from the detailed description of the drawings which follows, when considered with the attached figures.

DETAILED DESCRIPTION OF THE INVENTION

The invention is a novelty item. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a novelty item. The novelty item preferably has the appearance of a gaming machine "top", "candle" or "tower light." Most preferably, the novelty item is also configured to have utilitarian function, such as for use as a pencil holder, mug or the like.

Figure 1:
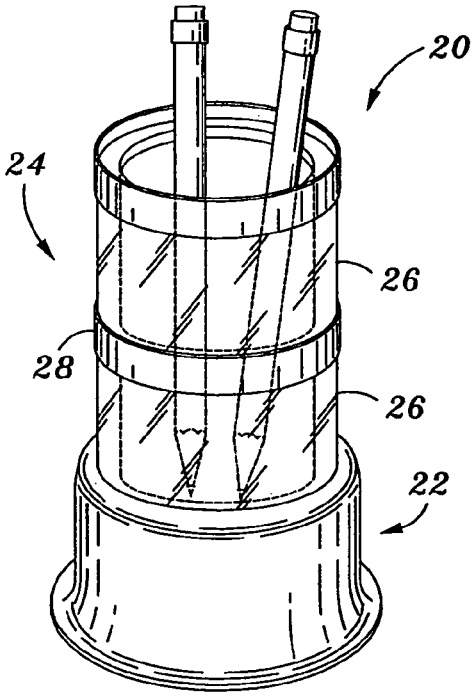
FIG. 1 is a perspective view of a first novelty item in accordance with the present invention, as used as a writing utensil holder.

FIG. 1 illustrates one embodiment of a novelty item 20 in accordance with the present invention. As illustrated, the novelty item 20 comprises a base 22 and a display 24, column or ornamental section extending upwardly therefrom. In a preferred embodiment, the display 24 is constructed of a plurality of segments 26. Preferably, pairs of segments 26 are separated by a divider 28.

In the preferred embodiment, the display 24 is configured to both display information and to contain or house material. The display 24 may be configured as a container having a generally open interior. As illustrated, a top of the display 24 is preferably open, thus providing access to the interior thereof.

Figure 2:
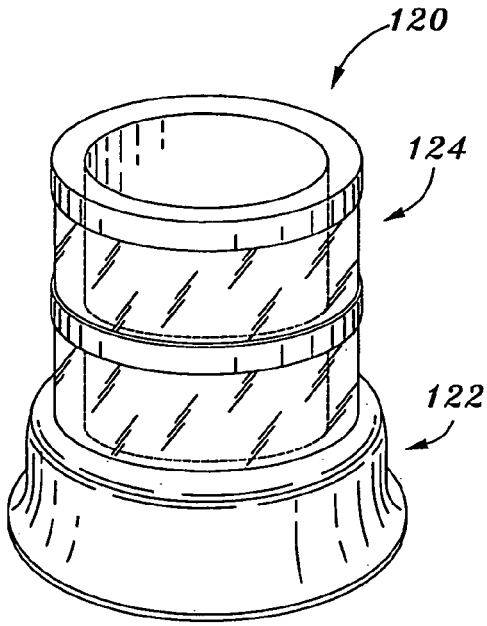
FIG. 2 is a perspective view of a second novelty item in accordance with the present invention, the item having particular utility as a liquid container.

The configuration of the display 24 may vary depending on the material to be contained partially or wholly thereby. For example, as illustrated in FIG. 1 the novelty item 20 is configured as a writing utensil holder (i.e. pen or pencil holder). In such an embodiment, the display 24 may be relatively tall as compared to its width dimension, whereby writing utensils are supported in a generally upright position. On the other hand, as illustrated in FIG. 2, a novelty item 120 is configured as a liquid container, such as a cup or mug. Preferably, in that configuration, the display 124 may be relatively wide compared to its height (and a base 122 thereof may be suitably enlarged for supporting the display 124).

Figure 3A:
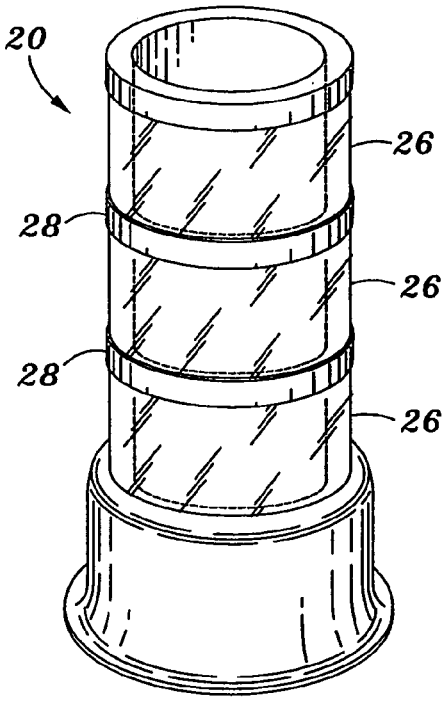
FIG. 3A is a perspective view of an alternate embodiment of the novelty item illustrated in FIG. 1.
Figure 3B:
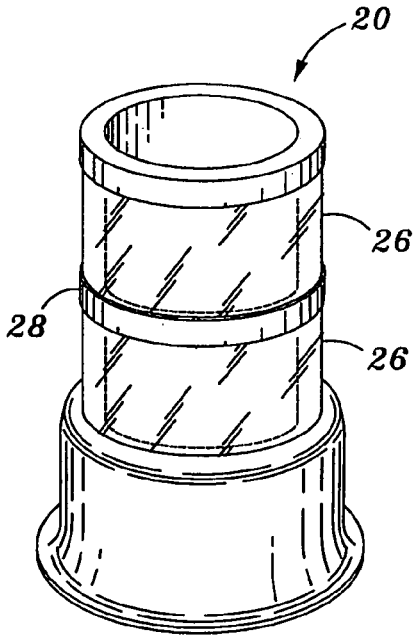
FIG. 3B is a perspective view of the novelty item illustrated in FIG. 1.

Referring to FIGS. 3A and 3B, the configuration of the display 24 maybe varied depending upon the number of segments 26 comprising the display. FIG. 3B illustrates an embodiment where the display 24 comprises only two segments 26 separated from one another by a single divider 28. FIG. 3A illustrates an embodiment where the display comprises three segments 26 separated by a two dividers 28. It will be appreciated that the display 24 could include as few as one, or four or more such segments.

Figure 4:
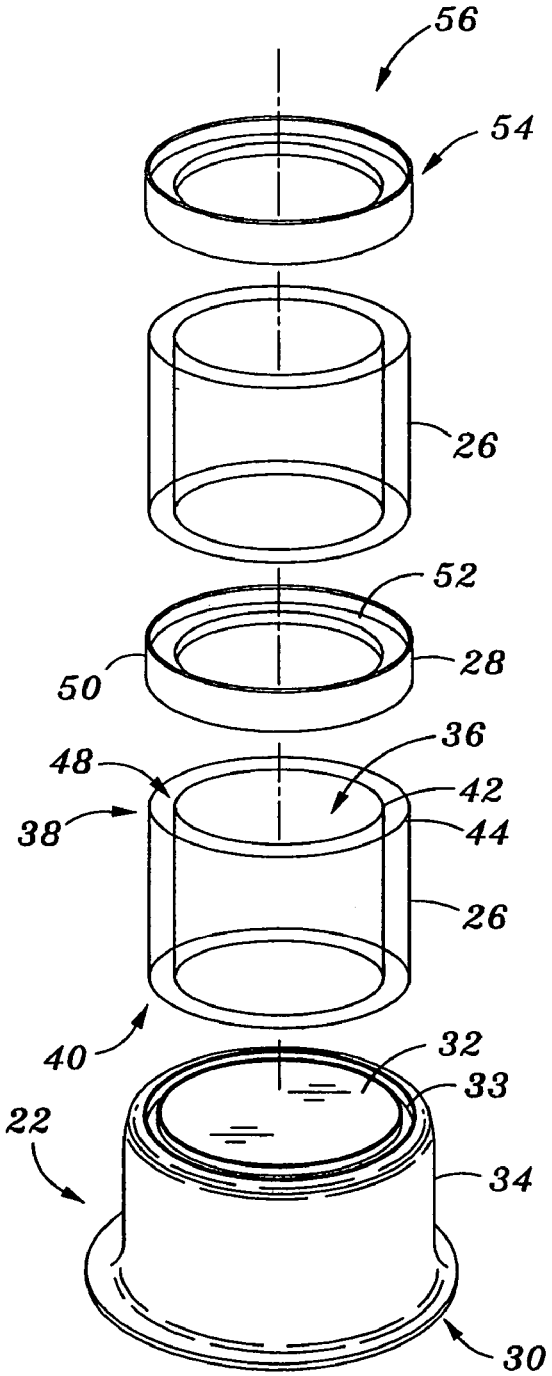
FIG. 4 is an exploded view of the novelty item illustrated in FIG. 1.
Figure 5:
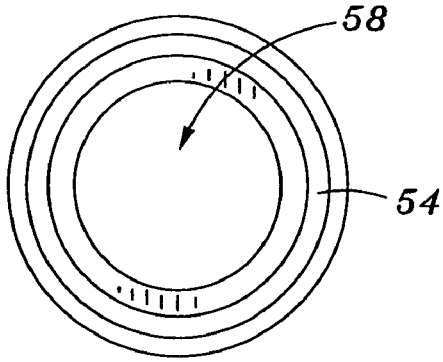
FIG. 5 is a top view of the novelty item illustrated in FIG. 1.

Additional details of one embodiment novelty item will now be described with reference to FIGS. 4-6. FIG. 4 illustrates one configuration for the novelty item 20 illustrated in FIG. 1.

As illustrated, the base 22 is somewhat cylindrical in shape. The base 22 could have a variety of shapes and sizes, however. The base 22 has a bottom 30 which is configured to rest upon a supporting surface. The base 22 has an opposing top 32 for supporting the display 24. The base 22 has an outer wall 34. The base 22 may be constructed of a variety of materials. In one embodiment, the base 22 is molded from plastic or a similar material. The base 22 could be constructed of metal or other materials, however. In one embodiment, the base 22 may be configured to have a desirable outward appearance, such as being chrome plated or the like.

The display 24 of the novelty item 20 illustrated includes two segments 26 and a single divider 28. In one embodiment, the segments 26 are cylindrical in shape. Each segment 26 defines a first interior space 36, and has a top 38 and a bottom 40.

Figure 6:
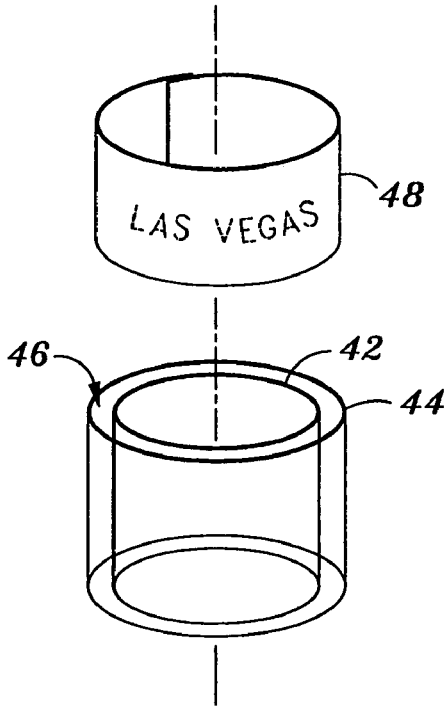
FIG. 6 illustrates a portion of the novelty item illustrated in FIG. 1 fitted with an insert.

In a preferred embodiment, as illustrated in both FIGS. 4 and 6, each segment 26 includes an inner wall 42 and an outer wall 44. The inner and outer walls 42,44 preferably extend generally parallel to one another, but are spaced from one another, such that a second interior space or area 46 is defined there between. Where the walls 42,44 are cylindrical, this space 46 is generally annular/cylindrical in shape.

In one embodiment, at least the outer wall 44 of the segment 26 is generally clear or transparent, so that a viewer of the novelty item 20 may see there through. In one embodiment, the inner wall 42 of the segment 26 may be colored, such as red, white or blue. In a preferred embodiment, the inner walls 42 of the segments 26 are different colors (such as red for the lower segment and white for the supper segment, where there are two segments, or red for the top segment, white for the middle segment and blue for the lower segment, when there are three segments). In this manner, the segments 26 of the display 24 have differing appearances.

In a preferred embodiment, as illustrated in FIG. 6, an insert 48 may be located in the space 46 between the inner and outer walls 42,44 of one or more of the segments 26. The insert 48 may comprise, for example, a printed piece of paper folded or wrapped into cylindrical form. The insert 48 could comprise a wide variety of media bearing text, images or other materials, and may be of a variety of shapes, sizes and colors. The insert 48 is preferably located within the space 46 and, when the outer wall 44 is generally transparent, is viewable through the outer wall 44.

Different inserts 48 maybe located in the spaces 46 of the different segments 26. The inserts 48 may thus be used to "customize" the novelty item 20 by displaying various text or images.

In an alternate, but less desirable configuration, one or both of the walls 42,44 may be directly printed or otherwise configured to bear text, images or the like. Also, in the event both walls 42,44 are generally transparent, an insert could be located within the central interior space of the display 24. A particular advantage of locating the insert 48 inside one or more of the segments 26 is that the insert 48 is protected from damage and is easily replaceable or changeable (once the wall 42,44 is directly printed, that printing may be hard to change).

Referring to FIG. 4 again, the divider 28 is preferably positioned between the two segments 26. Preferably, where the segments 26 are generally cylindrical in shape, the divider 28 is ring or cylinder-shaped, though the divider 28 may have a variety of shapes and sizes. In one embodiment, the divider 28 comprises an outer wall 50 and an inwardly extending stop or support 52. Preferably, the stop 52 extend inwardly between a top and bottom of the outer wall 50, and generally perpendicular thereto.

In use, a bottom portion of the outer wall 50 preferably extends over the top 38 of the segment 26 there below. The stop 52 rests upon the top 38 of that segment 26. The bottom of the segment 26 there above rests on the stop of the stop 52 and is supported thereby, with a top portion of the outer wall 50 extending upwardly along the segment. In this manner, the divider 28 covers the intersection of the two segments 26 and supports the segments 26 in a vertically stacked arrangement.

So configured, it will be appreciated that various segments 26 may be connected to one another with dividers 28, thereby increasing the height of the novelty item 20 (as illustrated when comparing the configuration in FIG. 3B to that illustrated in FIG. 3A).

In one embodiment, the segments 26 and divider 28 may be configured to press or interference fit with one another, thus providing secure connection there between. Alternately, the segments 26 may be connected to the divider 28 with adhesive, connectors, other types of mechanical locks (such as interlocking tabs and slots).

The dividers 28 may be constructed from a variety of materials. In one embodiment, the divider 28 is constructed of plastic. The divider 28 maybe ornamented, such as with chrome, so that it also serves as a visible divider between the segments 26.

In one embodiment, a cap 54 is located a top 56 of the novelty item 20. In one embodiment, the cap 54 is similar in configuration to the divider 28. The cap 54 could have other configurations. Preferably, the cap 54 is positioned over the top 38 of the top-most segment 26 forming the display 24. The cap 54 preferably aids in closing the interior space 46 of that top-most segment 26. As with the divider 28, the cap 54 may be configured to securely engage the top-most segment 26, so as to prevent inadvertent removal thereof.

As described above, in this embodiment, the novelty item 20 defines an interior space for containing all or part of one or more items. Referring to FIGS. 4 and 5, the top 56 of the novelty item 20 is preferably open and leads to an interior space 58 which is defined by the cap 54, segments 26 and dividers 28. In one embodiment, a portion of the interior space 58 might also be defined by the base 22.

As indicated, the display 24 portion of the novelty item 20 extends from, and is supported by, the base 22. In one embodiment, a slot or groove 33 is located in the top 32 of the base 22. The bottom 40 of the lowermost segment 26 is configured to engage this groove 33. That segment 26 may engage the base 22 via a mechanical connection (friction fit, threading arrangement, engaging tabs, etc.), by adhesive or other means, so as to generally retain the display 24 to the base 22.

As described, the novelty item 20 is preferably shaped and ornamented so that it has the appearance of a gaming machine tower light. In such instance, the appearance of the base 22, divider 28 and cap 54, along with the configuration/appearance of the segments 26 may be carefully chosen so that they emulate a tower light (such as by the base 22, divider 28 and cap 54 having a chrome or other metallic appearance, and by the segments 26 being colored).

As described with reference to FIG. 2, the novelty item may be configured to contain liquid. In such instance, the novelty item may still have the appearance of a tower light, but serve the function of a mug, cup or other container. In such instance, the interior space of the novelty item is preferably sealed to contain the liquid. For example, seals or sealant may be used at the inter-connection of the various components to seal them. In that embodiment, the novelty item could include additional features, such as a lid (for selectively opening and closing a top of the item), and handle or the like.

Figure 8:
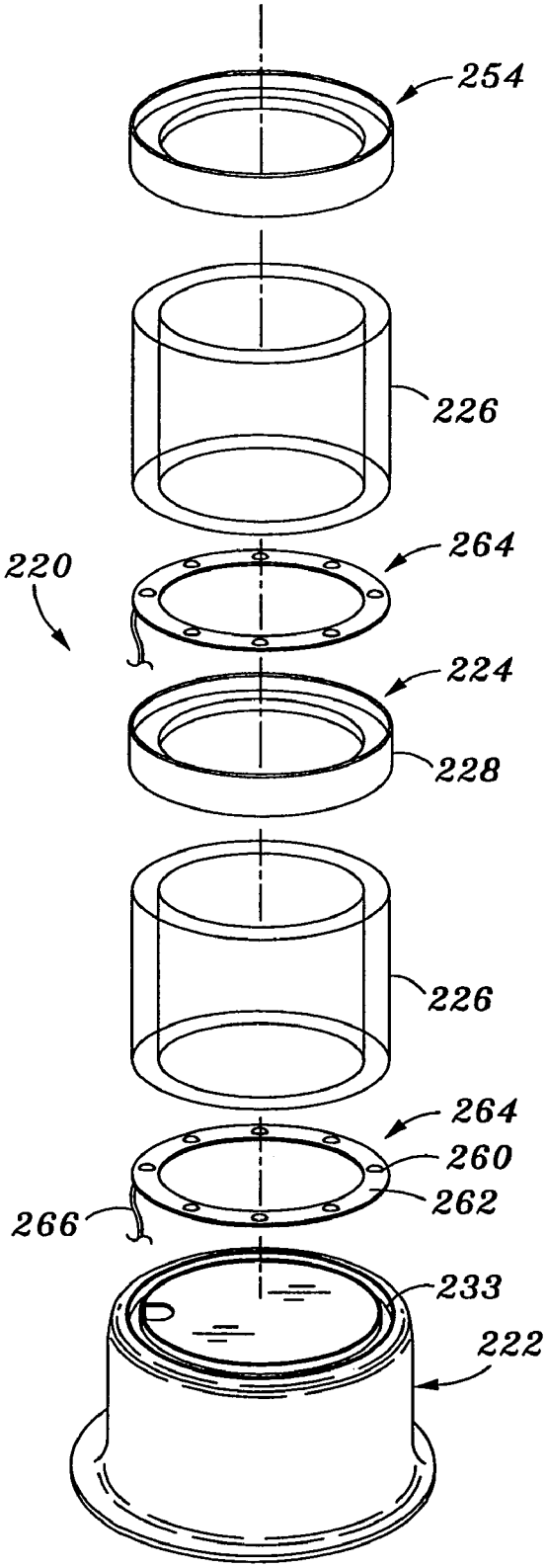
FIG. 8 is an exploded view of the novelty item illustrated in FIG. 7.
Figure 9:
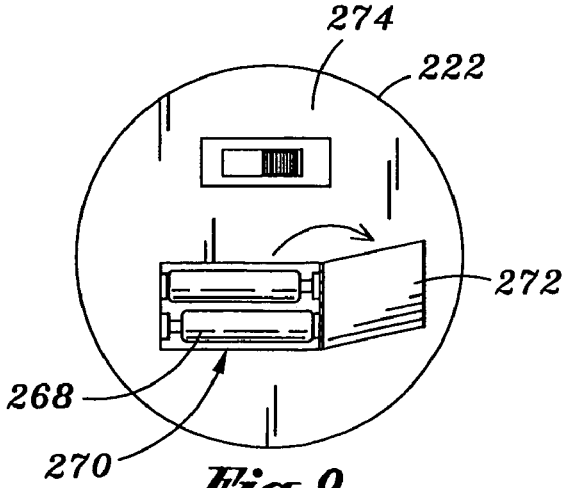
FIG. 9 is bottom view of the novelty item illustrated in FIG. 7.

Another embodiment novelty item 220 will now be described with reference to FIGS. 7-9. In the description and figures of this embodiment, like reference numbers will be used to designate like components to those of the novelty item 20 illustrated in FIGS. 1-6, described above.

This embodiment novelty item 220 again includes a base 222 and upwardly extending or standing display 224. The display 224 again preferably comprises one or more segments 226 with pairs of segments 26 separated by a divider 228. A cap 254 is located at a top 256 of the novelty item 220.

In this embodiment, the novelty item 220 preferably includes illumination means. In one embodiment, the novelty item 220 includes one or more lights.

In a preferred configuration, one or more lights 260 are arranged to illuminate at least one of the sections 226. As illustrated, a plurality of lights 260 may be associated with a support 262, thus forming a light ring or disc 264. In one embodiment, a light ring 264 is located at least one, and preferably each, segment 226.

The support 262 is preferably ring shaped when the segment 226 is cylinder shaped, such that the support 262 is shaped similar to the wall of the segment. In one embodiment, a plurality of lights 260 are associated with the support 262, such as by being spaced about or along the support. The lights 260 may be of a variety of types and configurations. In one embodiment, the lights 260 are LED type lights (but may be incandescent or other types).

The light ring 264 is preferably placed above or below a segment 226 and arranged to direct light towards the segment. As illustrated, the light rings 264 are shown located below each segment 226. In a preferred embodiment, the light ring 264 is positioned so that light is directed upwardly into the interior space 246 of the segment 226, thus illuminating the segment and any insert (not shown) which is located therein. Thus, in one embodiment, the lights 260 are positioned on the support 262 so as to be aligned with the interior space 246 of the corresponding segment 226.

Wiring 266 is preferably utilized to direct power to the light ring 264. The wiring 266 is preferably routed through an interior of the novelty item 220 so as to be hidden from view.

The lights 260 are preferably powered by a power source. In one embodiment, as seen in the bottom view of the item 220 as illustrated in FIG. 9, the novelty item 220 includes a self-contained power source. As illustrated, the base 222 may house one or more batteries 268. The one or more batteries 268 may be located in a compartment 270 located in the base 222, such as accessible from a bottom of the base 222 via a panel or door 272. Preferably, power is selectively provided via the one or more batteries 268 to the one or more lights 260 via the wiring 266.

In one embodiment, the novelty item 220 may include a switch 274 for selectively controlling the power to the lights 260, thus turning the lights on an off. As illustrated, such a switch 274 may be supported by the base 222. The switch 274 may be of a variety of types, such as the sliding-type switch illustrated, or other types such as push-buttons and the like.

Figure 7:
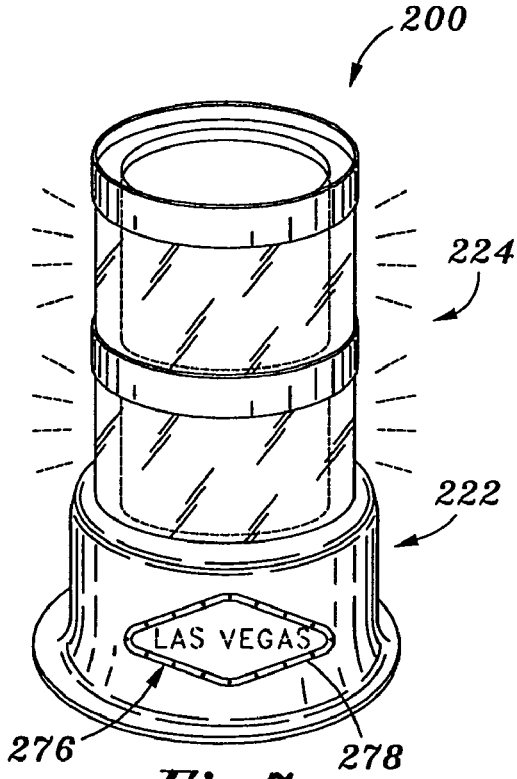
FIG. 7 is a perspective view of another novelty item in accordance with the present invention.

In this embodiment, as illustrated in FIG. 7, the novelty item 220 is configured to emit light. As described above, this light may also illuminate the novelty item 220, including the segments 226 and any inserts, text, graphics or the like.

In one embodiment, as illustrated in FIG. 7, a logo 276, such as text, designs or the like, may also be associated with the base 222. On one embodiment, the logo 276 may be formed as part of the base 222 (such as molded therewith, whether inset or protruding) or attached or connected thereto.

In one embodiment, one or more lights 278 may be associated with the logo 276, such as for illuminating the logo 276 or enhancing the logo. The logo 276 could be backlit. Alternatively, as illustrated, the light(s) 278 maybe used to enhance or set off the logo. In the embodiment illustrated, a plurality of lights 278 are inset into the logo 276. The lights 278 may again be of a variety of types, such as incandescent or LED. The lights 276 may be powered by the same or a different power source than the lights 260 associated with the display 224.

Again, the novelty item 220 preferably defines an interior for containing material. As illustrated, for example, the novelty item 220 may be used as a writing utensil holder. If properly sealed, the novelty item 220 may also be used to contain liquid.

Various aspects of the novelty item will now be appreciated. First, in a preferred embodiment, the novelty item generally resembles or has the appearance of a gaming machine top or tower light. In this regard, the novelty item is useful as a "gaming" souvenir, such as for tourists to gaming locations such as Las Vegas. In one embodiment, the novelty item is even illuminated, both making the item more visually appealing and interesting, but more closely mimicking an actual gaming machine top light.

In a preferred embodiment, the novelty item is also configured as a container and thus is useful for a variety of purposes/tasks other than as a souvenir. As indicated, the novelty item may be configured for use in containing liquid, such as a mug or cup, or as a writing utensil holder. The novelty item could be configured for a variety of purposes, however.

Various alternate embodiments of the novelty item other than those described specifically above are contemplated within the scope of the invention. For example, the top of the base of the novelty item may be inset both to accept the lower portion of the display and whereby a portion of the interior of the novelty item is defined by the base. In this embodiment, however, the bottom of the lower-most segment may be positioned within the open interior of the base, and the segment may extend upwardly from and outwardly of the base. In the case where the novelty item may be configured for use as a mug, this design increases the total capacity or container volume of the item.

As described, the segments, dividers and the like comprise individual elements. It is possible that one or more of the elements may be formed in unitary fashion. It is still desirable, however, for the display to have the appearance of segments divided from one another by dividers.

As indicated, the particular dimensions of the novelty item may vary. Where the novelty item is configured for desk-top placement and use, the novelty item may be about 1-6 inches wide and 4-10 inches tall, though the item may be larger or smaller, as desired. As also indicated, the particular shape of the item may vary. For example, the segments and dividers could be somewhat oval in cross-sectional shape, rather than circular. As illustrated, the segments are approximately the same size, including height. The segments could be of differing sizes, however. For example, the lower segment(s) might be taller than the upper segment(s).

In one embodiment, instead of the segments of the display portion of the novelty sign being of a two-walled construction, the segments could have a single wall construction. For example, the segments could be constructed of a clear plastic wall. An insert may then be located at the interior of the wall, such as by adhering it to the wall or by the insert being ring shaped and pressed into the interior of the segment. The insert might be colored and/or bear text, images or the like. In other configurations, the segments could be molded to include text, images or the like (such as by infusion of dye during molding) or text, images or the like could be associated with the segment(s) by other means, such as by printing (such as silk-screen printing).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A tower light novelty item comprising:

a base; and a display extending upwardly from said base, said display comprising at least a first segment and at least a second segment, said first and second segments each having an outer cylindrical wall and an inner cylindrical wall, said inner and outer walls separated from one another thereby defining a first interior space, and said inner cylindrical wall defining a second interior space therein, a divider located between said first and second segments, said divider supporting said second segment over said first segment in generally vertical alignment, said display having a generally open top leading to an interior of said display, said interior of said display defined by said second interior space of said first and second segment.

2. The tower light novelty item in accordance with claim 1 wherein said divider is ring-shaped and comprises a wall having a stop extending inwardly therefrom, said stop positioned between a top and a bottom of said wall.

3. The tower light novelty item in accordance with claim 2 wherein said wall of said divider extends over a portion of said first and second segments.

4. The tower light novelty item in accordance with claim 1 including an insert located in said first interior space of the first interior space of at least one of said first and second segments.

5. The tower light novelty item in accordance with claim 1 wherein said outer wall of said first and second segments is generally transparent.

6. The tower light novelty item in accordance with claim 1 including a cap located at a top of said display, said cap being ring-shaped and defining said open top of said display.

7. The tower light novelty item in accordance with claim 1 wherein said inner wall of said first and second segments is colored.

8. The tower light novelty item in accordance with claim 1 including at least one illumination means.

9. The tower light novelty item in accordance with claim 8 wherein said illumination means comprises at least one light ring positioned at a top or bottom end of at least one of said first and second segments.

10. The tower light novelty item in accordance with claim 1 including at least one light aligned with said first interior space of at least one of said first and second segments.

11. The tower light novelty item in accordance with claim 1 wherein at least one light is associated with said base.

12. The tower light novelty item in accordance with claim 1 wherein said base bears a logo.

13. The tower light novelty item in accordance with claim 1 wherein said display comprises a first segment, a second segment and a third segment, a first divider is positioned between said first and second segments and a second divider is positioned between said second and third segments.

14. The tower light novelty item in accordance with claim 1 wherein a bottom portion of said first segment is connected to said base.

15. A tower light novelty item comprising:

a base, a first display segment having a bottom and a top, said bottom of said display segment connected to said base;

a first divider located at said top of said first display segment;

a second display segment having a bottom and a top, said bottom of said second display segment connected to said first divider;

said first and second display segments having an annular configuration and defining an open interior area;

at least one illumination device associated with said novelty item and configured to illuminate at least one of said first and second display segments;

and at least one illumination device associated with said base.

16. The tower light novelty item in accordance with claim 15 further including a second divider located at said top of said second display segment and a third display segment having a bottom and a top, said bottom of said third display segment connected to said second divider.

17. The tower light novelty item in accordance with claim 15 wherein at least one of said first and second display segments displays text of graphic information.

18. The tower light novelty item in accordance with claim 15 wherein a first illumination device comprising a ring having at least one light mounted thereto is located at said bottom of said first display segment and a second illumination device comprising a ring having at least one light mounted thereto is located at said bottom of said second display segment.

* * * * *